US009032972B2

(12) United States Patent
Viegas

(10) Patent No.: US 9,032,972 B2
(45) Date of Patent: May 19, 2015

(54) DEVICE FOR APPLYING A FLUID TO KERATIN FIBRES

(75) Inventor: Manuel Viegas, Brunoy (FR)

(73) Assignee: MONTAIGU DEVELOPMENT, Chambourcy (FR)

( * ) Notice: Subject to any disclaimer, the term of this patent is extended or adjusted under 35 U.S.C. 154(b) by 0 days.

(21) Appl. No.: 13/997,586

(22) PCT Filed: Dec. 15, 2011

(86) PCT No.: PCT/FR2011/052997

§ 371 (c)(1),
(2), (4) Date: Aug. 14, 2013

(87) PCT Pub. No.: WO2012/085398

PCT Pub. Date: Jun. 28, 2012

(65) Prior Publication Data

US 2013/0319451 A1 Dec. 5, 2013

(30) Foreign Application Priority Data

Dec. 24, 2010 (FR) ..... 10 61250

(51) Int. Cl.
*A45D 40/26* (2006.01)
*A46B 11/00* (2006.01)
(Continued)

(52) U.S. Cl.
CPC ..... *A45D 40/262* (2013.01); *A46B 2200/1046* (2013.01); *A46B 1/00* (2013.01); *A46B 9/021* (2013.01); *A46B 2200/106* (2013.01)

(58) Field of Classification Search
CPC ..... A46B 9/021; A46B 9/025; A46B 9/028; A46B 7/00; A46B 7/02; A46B 7/023; A46B 1/00; A46B 3/005; A46B 3/00; A46B 2200/1046; A46B 2200/1053; A46B 2200/106; A45D 40/26; A45D 40/262; A45D 40/265; A45D 34/042
USPC ..... 132/218, 212, 107, 141, 142, 317, 318, 132/320, 120, 56; 401/118, 119, 121, 123, 401/126–129, 136, 137, 191, 266; 15/206, 15/207.2, 172
See application file for complete search history.

(56) References Cited

U.S. PATENT DOCUMENTS 2,429,437 A * 10/1947 Walker ..... 15/172
4,446,880 A * 5/1984 Gueret et al. ..... 132/218
(Continued)

FOREIGN PATENT DOCUMENTS

EP 1157632 A1 11/2001
EP 1593320 A1 11/2005
(Continued)

OTHER PUBLICATIONS

International Search Report, PCT/ FR2011/052997, Aug. 6, 2012, 4 pages.

*Primary Examiner* — Vanitha Elgart
(74) *Attorney, Agent, or Firm* — Abelman, Frayne & Schwab

(57) ABSTRACT

The present invention relates to a device for applying a fluid or pasty product to keratin fibers, comprising an elongate core (1) extending on a longitudinal axis XX. Advantageously, the device additionally comprises at least one pliant and flexible rod (2), which is oriented longitudinally and is embedded, at least at a first and a second point, on said longitudinal core (1), so as to form at least one zone of flexion perpendicular to the longitudinal axis XX; it is made in one piece and preferably from a plastic material.

28 Claims, 2 Drawing Sheets

(51) Int. Cl.

| | |
|---|---|
| ***A46B 9/02*** | (2006.01) |
| *A46B 1/00* | (2006.01) |

(56) References Cited

U.S. PATENT DOCUMENTS

| | | | | |
|---|---|---|---|---|
| 4,545,393 | A * | 10/1985 | Gueret et al. | 132/218 |
| 4,869,612 | A * | 9/1989 | Mooney et al. | 401/130 |
| 5,123,431 | A * | 6/1992 | Wilson | 132/320 |
| 5,542,439 | A * | 8/1996 | Gueret | 132/218 |
| 5,894,847 | A * | 4/1999 | Gueret | 132/218 |
| 6,067,997 | A * | 5/2000 | Gueret | 132/218 |
| 6,494,215 | B2 * | 12/2002 | Gueret | 132/218 |
| 6,662,810 | B2 * | 12/2003 | Gueret | 132/218 |
| 7,467,905 | B2 * | 12/2008 | Habatjou | 401/127 |
| 7,914,221 | B2 * | 3/2011 | Milesi et al. | 401/127 |
| 7,980,253 | B2 * | 7/2011 | Dumler | 132/218 |
| 8,082,928 | B2 * | 12/2011 | Gueret | 132/218 |
| 8,191,559 | B2 * | 6/2012 | Bickford | 132/218 |
| 8,210,763 | B2 * | 7/2012 | Gueret | 401/129 |
| 2002/0014250 | A1 | 2/2002 | Gueret | |
| 2002/0020426 | A1 * | 2/2002 | Gueret | 132/218 |
| 2005/0217691 | A1 * | 10/2005 | Petit | 132/320 |
| 2005/0249539 | A1 | 11/2005 | Habatjou | |
| 2006/0279181 | A1 | 12/2006 | Gueret | |
| 2007/0172302 | A1 | 7/2007 | Milesi et al. | |
| 2008/0011317 | A1 * | 1/2008 | Malvar et al. | 132/218 |
| 2008/0023020 | A1 | 1/2008 | Gueret | |
| 2009/0065020 | A1 * | 3/2009 | Butcher et al. | 132/218 |
| 2010/0192968 | A1 * | 8/2010 | Gueret | 132/200 |
| 2010/0200013 | A1 * | 8/2010 | Kim | 132/218 |
| 2010/0288296 | A1 * | 11/2010 | Takata et al. | 132/218 |
| 2014/0246043 | A1 * | 9/2014 | Befve et al. | 132/218 |

FOREIGN PATENT DOCUMENTS

| | | | |
|---|---|---|---|
| EP | 1726234 | A2 | 11/2006 |
| FR | 2 895 218 | A1 | 6/2007 |
| FR | 2 902 984 | A1 | 1/2008 |

* cited by examiner

DEVICE FOR APPLYING A FLUID TO KERATIN FIBRES

RELATED APPLICATIONS

This application is a United States national phase application under 35 USC §371 of PCT/FR2011/052997 filed on Dec. 15, 2011, and claims the benefit under 35 USC §119 of French patent application number FR 1061250 filed Dec. 24, 2010, the disclosures of which are incorporated herein by reference in their entireties.

TECHNICAL FIELD OF THE INVENTION

The invention relates to the field of applicators for applying a fluid or viscous product to keratin fibres such as eyelashes or eyebrows. In particular the applicators to which the invention relates make it possible to apply a cosmetic, makeup or care product to hair, eyelashes or eyebrows.

These applicators comprise essentially two elements: a core of elongate shape on which at least one row of teeth or spikes is disposed.

PRIOR ART

Numerous documents are known that disclose products of this type that aim above all to load and then apply the appropriate product easily, simply and reliably, with a harmonious result. In the field in question, loading function, separation function, definition function or curving function, which must be performed by such an applicator, are spoken of.

For some time now, for example through the teaching of the document FR 2 505 633, a makeup brush having a support on which bristles are individually and evenly implanted is known. According to one feature of this invention, the support and the bristles come from the injection of a mouldable material.

By way of illustration, the document FR 2 850 549 discloses a brush for applying a product to keratin fibres, comprising a core supporting bristles, at least some of which extend in a curved manner.

Through the document FR 2 902 984, an applicator is also known comprising a core and at least two rows of teeth each oriented differently vis-à-vis an external face of the core. This type of applicator aims to improve the application of a product in particular in terms of penetration of the teeth between the eyelashes or others, smoothing the product on the eyelashes and separating them.

The document EP 1 593 320 is also known, which describes a mascara applicator consisting of several parts able to move with respect to one another and in particular a support element in which an adjustment element can slide axially. This mobility makes it possible to act on the distance between the two ends of a deformable portion of the support element. It is the user herself who modifies the distance between the two ends and therefore the external volume of the applicator, which comprises parts radially deformable under the action of the adjustment element.

It is considered that the user can thus act on the quantity of product with which the applicator is loaded. This applicator is different, and complex to produce since it is formed from several parts. It requires adjustment by the user before use thereof. In addition, the geometry disclosed comprises a continuous circumference around the longitudinal axis, which is in no way the subject matter of the present patent application. Moreover, this prior art does not disclose at least one flexible rod forming a single piece with the longitudinal core and embedded at at least two points on this longitudinal core.

Moreover, the patent application FR 2 895 218 A1 discloses an applicator with a design close to that described in the document EP 1 593 320; this is because this applicator is complex, consisting of several distinct elements including in particular a central actuation rod and several so-called axial elements secured at each of their ends by rings. The user can extend the axial elements to a greater or lesser extent, by acting for example on a knurled wheel that cooperates with the rings.

Moreover, the objective of the applicator described in this document is to modify the internal space so as to act on the quantity of cosmetic product retained in the applicator.

Furthermore, the patent application FR 2 506 581 A1 shows a makeup brush of the same type as those disclosed above, consisting of several parts able to move with respect to one another.

Through the French patent application EN 1052316, an applicator device for adjusting and/or controlling the flexibility of the teeth that constitute it is also known; this device thus consists of a core and several rows of spikes; a first series of spikes extends from the core as far as a longitudinal rod while a second series of spikes has a first end connected to the rod and a second free end. This type of applicator makes it possible to adjust and/or control the flexibility of the teeth (or spikes). However, such an applicator lacks radial flexibility; it is very little deformable radially, which is a drawback when it is a case of passing it through an annular element called a wiper placed at the outlet of the container for the product to be applied. This is because the "load", that is to say the quantity of product engaged on the device, is not optimum and may be insufficient for good application to the eyelashes, with such a known device.

DISCLOSURE OF THE INVENTION

The invention aims to remedy the drawbacks of the prior art and in particular to propose a device for applying liquid or viscous products in the field of cosmetics or hair care, which makes it possible to keep an optimum load of product after having passed through a small-diameter wiper.

To do this there is proposed, according to a first aspect of the invention, a device for applying a fluid or viscous product to keratin fibres, comprising an elongate core extending along a longitudinal axis XX, which is produced from plastic material and is obtained by injection in a single molded part; this device furthermore comprises at least one supple flexible rod oriented longitudinally and embedded at at least first and second points on said longitudinal core, so as to provide at least one flexion area perpendicular to the longitudinal axis XX.

"Longitudinal axis" means the line that joins the barycentres of the transverse sections of the core. The longitudinal axis may be a principal axis or even a symmetry axis for the core.

"Embedded" means a mechanical embedding and may comprise a fixing, a fusion or any other way of connecting together the ends of at least one rod and the core of the device. More specifically a connection on the external wall of the core is provided.

The fact that the applicator according to the invention is produced in a single piece, that is to say monolithic, constitutes a simplification in manufacture; in addition the characteristic form of the device according to the invention offers the user a quality of application that is quite remarkable.

According to one feature of the invention, at least one rod is embedded at each of its ends substantially merged with each end of said elongate core.

Moreover, at least one rod has at least one concave or convex curvature vis-à-vis the longitudinal axis XX. A rod may have a single curvature, convex or concave, along the entire length of the core, but other possibilities can be envisaged without departing from the scope of the invention, such as for example several curvatures.

Without departing from the scope of the invention, said at least one rod comprises at least first and second rectilinear parts disposed so that one of their ends coincides with the first or second end of the longitudinal core and in that their other ends coincide with each other.

According to one particularity of the invention, said at least one rod has an external surface that is not smooth (with hollows). It is here possible to imagine a bumpy external surface, provided with holes and/or protuberances, which may have various functionalities in themselves.

Additionally, the device may comprise spikes that may be connected to at least one of said rods, and/or which may be connected to the external wall of the core.

Preferably said spikes are oriented substantially radially vis-à-vis the longitudinal axis XX.

In addition said at least one rod has a transverse section with a value less than the transverse section of the core. Thus the rigidity of the device is essentially provided by the core while the rod or rods remain more flexible than the core, assuming of course that the core and the rod or rods consist of the same single material or at least a material having similar rigidity characteristics.

According to one embodiment of the invention, the device comprises at least three longitudinal rods regularly spaced apart angularly on a transverse section of the core.

As will be described in more detail below, various embodiments of the invention can be envisaged without departing from the scope of the invention.

BRIEF DESCRIPTION OF THE FIGURES

Other features, details and advantages of the invention will emerge from a reading of the following description with reference to the accompanying figures, which illustrate:

FIGS. 1A to 5A, views in transverse section of the device according to the embodiments in FIGS. 1 to 5;

FIGS. 1B to 5B, views in perspective of the device according to the embodiments in FIGS. 1 to 5;

FIGS. 7A to 10A are transverse sections of the embodiments in FIGS. 7 to 10.

For more clarity, identical or similar elements are marked by identical reference signs in all the figures.

DETAILED DESCRIPTION OF AN EMBODIMENT

The present invention therefore presents numerous variants naturally having common novel and inventive features.

An applicator device is proposed, also referred to as a "brush" in the remainder of this text in the normal fashion.

The device according to the invention comprises a core 1 that extends longitudinally along an axis XX. The core may have a transverse section that is constant or not along its length. The most usual embodiments show a constant transverse section or a transverse section that decreases from its end in engagement with a tube and/or a gripping sleeve as far as its free distal end.

The transverse section of the core 1 may have a circular, polygonal, oval or other form; it is axisymmetric. The core may be made from solid material, or hollow. FIG. 4A illustrates a hollow cylindrical core 1. A person skilled in the art will choose the most appropriate type of core according to economic and/or technical constraints.

According to the invention at least one rod 2 is provided and extends along the length or the axis XX. The rod 2 is supple and flexible along its length; it advantageously has elasticity allowing a variation in the outside diameter of the device, as explained below.

The rod 2 is advantageously embedded at at least first and second points on the longitudinal core, so as to provide at least one radial flexion area, that is to say perpendicular to the longitudinal axis XX.

The rod 2 may, as can be seen in the illustrated figures, be embedded at each of its ends, which coincide with the ends of the elongate core 1. This is however not obligatory and a rod 2 embedded on the core 1 at other points or areas can be envisaged; in these configurations the rod has more than one curvature.

Preferentially, the rod 2 has a single curvature along the length of the core 1; all the figures show this feature. In FIGS. 1 and 4 to 9 the curvature of the rod 2 has a convexity vis-à-vis the core; in FIGS. 3 and 10 the rod or rods 2 have a concavity vis-à-vis the core 1.

Figure 2:
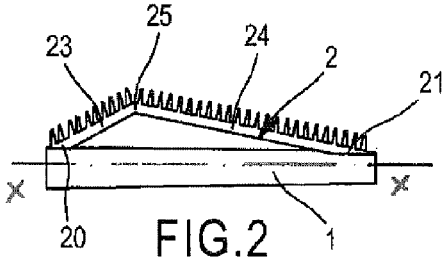
Figure 2A:
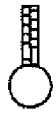
Figure 2B:
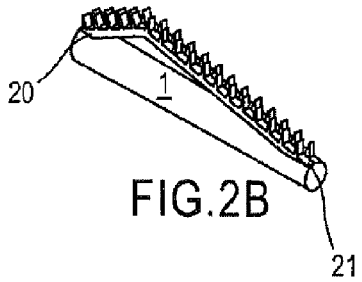

It can be envisaged, according to the invention as illustrated in FIGS. 2, 2A and 2B, providing at least one rod 2 that is not curved but formed by at least a first 23 and second 24 rectilinear part, one of the ends of which is embedded and coincides with one of the ends of the core 1, and the other ends 25 of which coincide with each other.

In all cases it is a question of providing at least one flexion area for the rod or rods 2 so that the brush can easily pass through an element of the wiper type as defined above, forming part of a mascara container. The brush according to the invention can be radially compressed on passing through a wiper and then expand radially outside the mascara container. This makes it possible to keep a load of fluid or viscous product such as mascara in the areas of the brush, unlike the prior art where the product is little retained by the brush after passing through the wiper.

Figure 5:
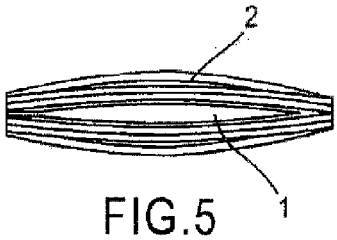
Figure 5A:
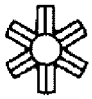
Figure 5B:
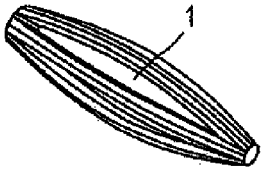

In addition, the brush according to the invention can be provided with spikes 3 that can be fixed to the rod or rods 2; all the figures show this feature except for FIGS. 5, 5A and 5B, where the rods are not provided with spikes. The spikes 3 may also be fixed directly to the core 1 of the brush; FIGS. 6, 6A, 6B, 10 and 10A illustrate these embodiments of the invention. The spikes may be straight or curved, oriented radially or not.

Moreover, the rod or rods 2 may have a non-smooth external surface, more particularly provided with hollows in which spikes 3 can be implanted.

According to one embodiment of the invention, the device is produced from a plastic material, obtained by injection in a single molded part.

Advantageously the rod or rods 2 constituting the brush have a transverse section smaller than that of the average transverse section of the core 1. Thus most of the rigidity of the device is produced by the core 1, assuming of course that the core and rods consist of the same material.

A device according to the invention comprises at least one rod 2, preferably with several beams; the number thereof may amount to up to 16, for brushes of the mascara type having a length of 2 to 3 cm, and the maximum outside diameter of which is around 1 cm. The elasticity of the rod or rods 2 is such that it allows a variation in the outside diameter of the device of around 10% of its length.

Figure 1:
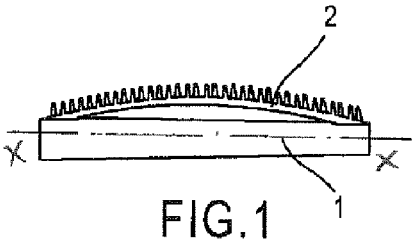
FIGS. 1 to 5, views in longitudinal section of the device according to several embodiments of the invention.
Figure 1A:
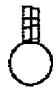
Figure 1B:
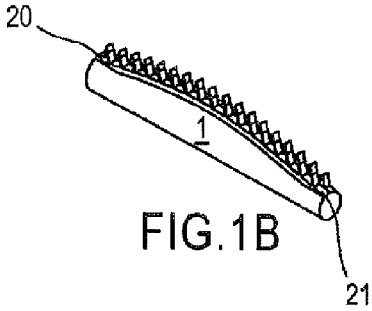

Illustrative examples of the invention are shown in the accompanying figures, in which:

FIGS. 1, 1A and 1B show a brush provided with a rod 2 embedded at each of its ends 20, 21 on the core 1; the rod is curved, arched towards the outside, with a convexity turned towards the core. Spikes 3 are provided, attached to the rod 2, oriented radially. Specifically the spikes 3 are here aligned in two rows and are offset along the length of the rod so that alternately a spike in the first row and a spike in the second row are found along the length of the rod 2.

FIGS. 2, 2A and 2B illustrate an embodiment that differs from the one in FIGS. 1, 1A and 1B through the form of the rod 2, which here consists of two rectilinear parts 23, 24 that join at one of their ends and the other ends of which are each embedded at an end of the core 1.

Figure 3:
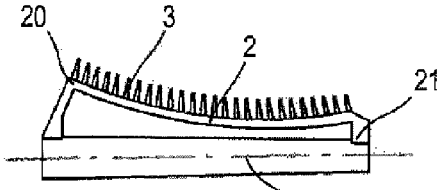
Figure 3A:
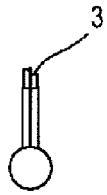
Figure 3B:
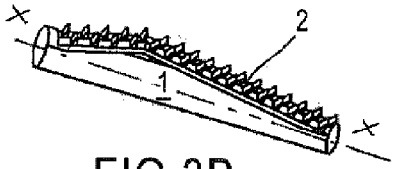

FIGS. 3, 3A and 3B show an embodiment where the rod or rods 2 are curved, with the concavity turned towards the outside of the brush.

Figure 4:
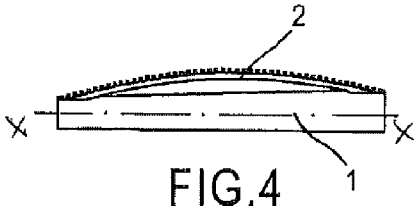
Figure 4A:
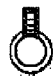
Figure 4B:
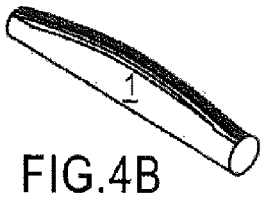

FIGS. 4, 4A and 4B concern a brush that differs from the one in FIG. 1 to the form of the spikes 3 which, here, form a single row and the width of which correspond substantially to that of the rod 2. It should be noted that, according to this embodiment, the core 1 is hollow and cylindrical.

FIGS. 5, 5A and 5B relate to a brush provided with several rods 2 not provided with spikes 3. The rods 2, here six in number, are regularly distributed around the core 1.

Such a distribution of the rods 2 can be envisaged for all the embodiments of the invention.

Figure 6:
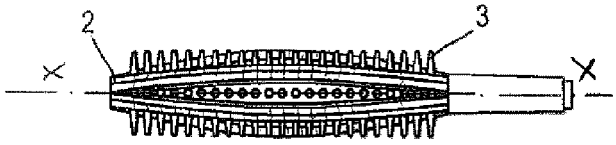
FIGS. 6, 6A and 6B concern respectively a side view, a transverse section and a perspective view of another embodiment of the invention.
Figure 6A:
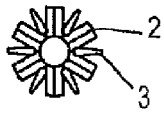
Figure 6B:
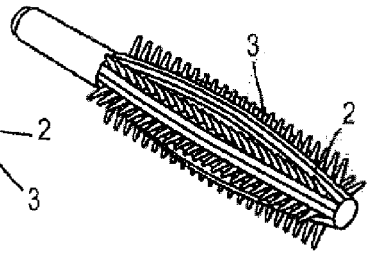

FIGS. 6, 6A and 6B illustrate a brush comprising both rods 2 distributed around the core 1 and rows of spikes 3 radially interposed between the rods 2. The rods 2 may be provided or not with spikes 3.

Figure 7A:
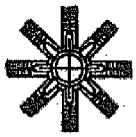
Figure 7:
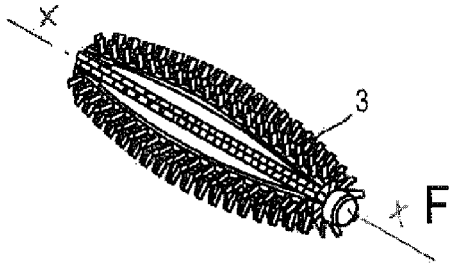
FIGS. 7 to 10 illustrate by perspectives yet other embodiments of the invention.

FIGS. 7 and 7A show an applicator device comprising eight curved rods 2 distributed around the core 1, each rod being provided with two rows of spikes.

Figure 8A:
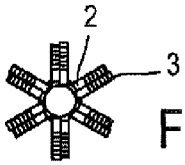
Figure 8:
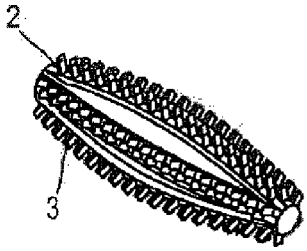

FIGS. 8 and 8A differ from FIGS. 1, 1A and 1B through the number of rods fixed to the core 1; here six rods are provided.

Figure 9A:
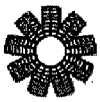
Figure 9:
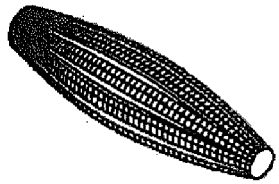

FIGS. 9 and 9A show a brush where nine rods 2 are fixed to the core 1. The rods 2 have a non-smooth external surface with recesses that may remain as they are or may serve for embedding spikes.

Figure 10A:
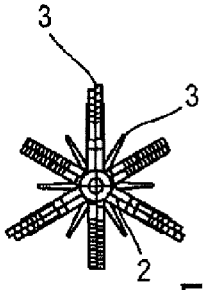
Figure 10:
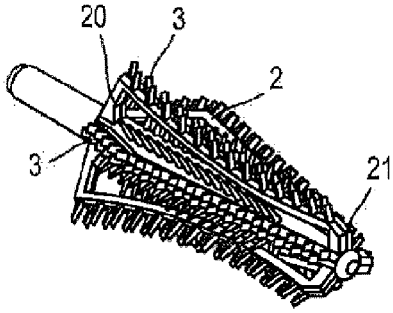

FIGS. 10 and 10A concern a "mixed" brush comprising a plurality of curved rods as shown in FIG. 3 and a plurality of rods in two parts as shown in FIG. 2. As shown clearly by FIG. 10A, such a brush comprises three curved rods between which three rods in two parts are radially interposed.

Naturally, all the combinations of rods and/or spikes can be envisaged without departing from the scope of the invention.

The transverse section of each rod 2 may be constant over its length or may be variable.

The invention claimed is:

1. Device for applying a fluid or viscous product to keratin fibres, comprising an elongate core extending along a longitudinal axis, characterised in that it is produced from a plastic material, obtained by injection in a single molded part, in that it furthermore comprises at least one supple flexible rod oriented longitudinally and embedded at at least first and second points on said elongate core so as to provide at least one flexion area perpendicular to the longitudinal axis, and in that it also comprises spikes molded integrally with said elongate core and oriented substantially radially vis-à-vis the longitudinal axis.

2. Device according to claim 1, characterised in that said at least one rod is embedded at each of its ends substantially merged with each end of said elongate core.

3. Device according to any one of the preceding claims, characterised in that said at least one rod has at least one concave or convex curvature vis-à-vis the longitudinal axis.

4. Device according to either one of claim 1 or 2, characterised in that said at least one rod comprises at least first and second rectilinear parts disposed so that a first end of the first rectilinear part coincides with a first point on the longitudinal core, a first end of the second rectilinear part coincides with a second point on the longitudinal core, and a second end of the first rectilinear part coincides with a second end of the second rectilinear part.

5. Device according to either one of claim 1 or 2, characterised in that said at least one rod has a non-smooth external surface.

6. Device according to either one of claim 1 or 2, further comprising additional spikes fixed to said at least one rod.

7. Device according to either one of claim 1 or 2, characterised in that said at least one rod has a transverse section with a value less than the transverse section of the core.

8. Device according to either one of claim 1 or 2, characterised in that it comprises at least three longitudinal rods regularly distributed angularly over a transverse section of the core.

9. Device for applying a fluid or viscous product to keratin fibres, comprising an elongate core extending along a longitudinal axis that it is produced from a plastic material, obtained by injection in a single molded part, at least one supple flexible rod oriented longitudinally and embedded at at least first and second points on said elongate core so as to provide at least one flexion area perpendicular to the longitudinal axis, wherein said supple flexible rod does not contain spikes, and spikes oriented substantially radially vis-à-vis the longitudinal axis and fixed to or monolithically formed with the elongate core.

10. Device according to claim 9, wherein said at least one rod comprises at least first and second rectilinear parts disposed so that a first end of the first rectilinear part coincides with a first point on the longitudinal core, a first end of the second rectilinear part coincides with a second point on the longitudinal core, and a second end of the first rectilinear part coincides with a second end of the second rectilinear part.

11. Device for applying a fluid or viscous product to keratin fibres, comprising an elongate core extending along a longitudinal axis, characterised in that it is produced from a plastic material, obtained by injection in a single molded part, in that it furthermore comprises at least one supple flexible rod oriented longitudinally and embedded at at least first and second points on said elongate core so as to provide at least one flexion area perpendicular to the longitudinal axis, and in that it also comprises spikes molded integrally with one or more of the at least one supple flexible rods, the spikes oriented substantially radially vis-à-vis the longitudinal axis.

12. Device according to claim 11, characterised in that said at least one rod is embedded at each of its ends substantially merged with each end of said elongate core.

13. Device according to either one of claim 11 or 12, characterised in that said at least one rod has at least one concave or convex curvature vis-à-vis the longitudinal axis.

14. Device according to either one of claim 11 or 12, characterised in that said at least one rod comprises at least first and second rectilinear parts disposed so that a first end of the first rectilinear part coincides with a first point on the longitudinal core, a first end of the second rectilinear part coincides with a second point on the longitudinal core, and a second end of the first rectilinear part coincides with a second end of the second rectilinear part.

15. Device according to either one of claim 11 or 12, characterised in that said at least one rod has a transverse section with a value less than the transverse section of the core.

16. Device according to either one of claim 11 or 12, characterised in that it comprises at least three longitudinal rods regularly distributed angularly over a transverse section of the core.

17. Device for applying a fluid or viscous product to keratin fibres, comprising an elongate core extending along a longitudinal axis, characterised in that it is produced from a plastic material, obtained by injection in a single molded part, in that it furthermore comprises at least one supple flexible rod oriented longitudinally and embedded at at least first and second points on said elongate core so as to provide at least one flexion area perpendicular to the longitudinal axis, and in that one or more of the at least one supple flexible rods is provided with hollows through which spikes are implanted and oriented substantially radially vis-à-vis the longitudinal axis.

18. Device according to claim 17, characterised in that said at least one rod is embedded at each of its ends substantially merged with each end of said elongate core.

19. Device according to either one of claim 17 or 18, characterised in that said at least one rod has at least one concave or convex curvature vis-à-vis the longitudinal axis.

20. Device according to either one of claim 17 or 18, characterised in that said at least one rod comprises at least first and second rectilinear parts disposed so that a first end of the first rectilinear part coincides with a first point on the longitudinal core, a first end of the second rectilinear part coincides with a second point on the longitudinal core, and a second end of the first rectilinear part coincides with a second end of the second rectilinear part.

21. Device according to either one of claim 17 or 18, characterised in that said at least one rod has a transverse section with a value less than the transverse section of the core.

22. Device according to either one of claim 17 or 18, characterised in that it comprises at least three longitudinal rods regularly distributed angularly over a transverse section of the core.

23. Device for applying a fluid or viscous product to keratin fibres, comprising an elongate core extending along a longitudinal axis, characterised in that it is produced from a plastic material, obtained by injection in a single molded part, in that it furthermore comprises at least one supple flexible rod oriented longitudinally and embedded at at least first and second points on said elongate core so as to provide at least one flexion area perpendicular to the longitudinal axis, and in that it also comprises spikes molded integrally with one or more of the at least one supple flexible rods, and spikes molded integrally said elongate core, said spikes oriented substantially radially vis-à-vis the longitudinal axis.

24. Device according to claim 23, characterised in that said at least one rod is embedded at each of its ends substantially merged with each end of said elongate core.

25. Device according to either one of claim 23 or 24, characterised in that said at least one rod has at least one concave or convex curvature vis-à-vis the longitudinal axis.

26. Device according to either one of claim 23 or 24, characterised in that said at least one rod comprises at least first and second rectilinear parts disposed so that a first end of the first rectilinear part coincides with a first point on the longitudinal core, a first end of the second rectilinear part coincides with a second point on the longitudinal core, and a second end of the first rectilinear part coincides with a second end of the second rectilinear part.

27. Device according to either one of claim 23 or 24, characterised in that said at least one rod has a transverse section with a value less than the transverse section of the core.

28. Device according to either one of claim 23 or 24, characterised in that it comprises at least three longitudinal rods regularly distributed angularly over a transverse section of the core.

* * * * *